US005512724A

United States Patent [19]

Binder et al.

[11] Patent Number: 5,512,724

[45] Date of Patent: Apr. 30, 1996

[54] VACUUM SWITCH WITH A DRIVE DEVICE AND POLE OPERATING UNIT

[75] Inventors: Manfred Binder; Detlev Schmidt; Norbert Steinemer, all of Berlin, Germany

[73] Assignee: Siemens Aktiengesellschaft, Munich, Germany

[21] Appl. No.: 211,366

[22] PCT Filed: Sep. 11, 1992

[86] PCT No.: PCT/DE92/00784

§ 371 Date: May 25, 1994

§ 102(e) Date: May 25, 1994

[87] PCT Pub. No.: WO92/18585

PCT Pub. Date: Oct. 29, 1992

[30] Foreign Application Priority Data

Sep. 30, 1991 [DE] Germany ..... 41 33 091.9

[51] Int. Cl.[6] ..... H01H 33/42

[52] U.S. Cl. ..... 218/140; 218/139; 218/154; 218/155

[58] Field of Search ..... 218/118, 121, 218/134, 139, 140, 154, 155

[56] References Cited

U.S. PATENT DOCUMENTS

| | | | |
|---|---|---|---|
| 3,632,933 | 1/1972 | McClain | 200/153 SC |
| 4,419,553 | 12/1983 | Ohshita et al. | 200/144 B |
| 4,654,494 | 3/1987 | Wüthrich | 200/337 |
| 4,684,771 | 8/1987 | Wüthrich | 200/144 B |
| 5,055,640 | 10/1991 | Lippi et al. | 200/144 B |
| 5,422,450 | 6/1995 | Miyazawa et al. | 218/140 |

FOREIGN PATENT DOCUMENTS

| | | | |
|---|---|---|---|
| 0172986 | 3/1985 | European Pat. Off. | H01H 33/66 |
| 8905949 | 5/1989 | Germany | H01H 33/66 |
| 1576211 | 10/1980 | United Kingdom | H01H 33/66 |

*Primary Examiner*—Kristine L. Kincaid
*Assistant Examiner*—Michael A. Friedhofer
*Attorney, Agent, or Firm*—Kenyon & Kenyon

[57] ABSTRACT

A vacuum switch including at least one vacuum switching tube and a pole operating unit which receives the vacuum switching tube at one of its ends. Each pole operating unit contains a lever arrangement for changing the direction of the operating movement provided by a drive device to the associated vacuum switching tube and a contact force spring. In addition, a connection contact surface for an external conductor is provided. The pole operating unit has a U-shaped carrier with elastically bendable legs. A connection device, also having a U-shaped cross-section, engages outside of the legs of the U-shaped carrier. A counter-bearing for the contact force spring is attached between the legs with when the legs of the carrier are bent. Alternatively, a cast metal connection device provided with cooling ribs can also be used.

9 Claims, 3 Drawing Sheets

VACUUM SWITCH WITH A DRIVE DEVICE AND POLE OPERATING UNIT

The invention relates to a vacuum switch with the following features:

- a drive device for providing an operating force for at least one vacuum switching tube; a pole operating unit which receives the vacuum switching tube at one of its ends and consists of a carrier, a lever arrangement which changes the direction of movement of the drive device and of a connection device for connecting a movable operating plunger of the vacuum switching tube to an external conductor;
- the carrier is constructed as a U-shaped sheet-metal part with a central part and two legs;
- a support insulator for connecting the drive device to the carrier is attached at one of its ends to the central part of the carrier;
- aligned elongated holes are arranged in the legs of the carrier in order to receive the ends of a bolt which guides the operating plunger of the vacuum switching tube linearly and transmits an operating force;
- an insulating coupling rod for connecting the drive device to the direction-changing lever arrangement and a contact force spring which is to be tensioned when the vacuum switching tube is switched on and a counter-bearing which supports the contact force spring is arranged between the legs of the carrier, A vacuum switch with these features has been disclosed in U.S. Pat. No. 4,654,494. On the basis of the above, the invention is based on the object of designing the pole operating unit in such a way that its individual parts can be assembled easily and that the pole operating unit is as lightweight as possible and yet has a high degree of mechanical strength.

This subject is achieved according to the invention by means of the following further feature:

- the distance between the legs of the carrier can be extended by elastic bending;
- the counter-bearing of the contact force spring is arranged in a fixed fashion and is of plate-shaped construction with a width which corresponds to the distance between the legs in the state of rest;
- on the narrow sides of the counter-bearing which are intended to rest against the legs of the carrier, pins for engaging in associated holes of the legs are arranged and the connection device is constructed as an assembly which connects and strengthens the legs.

On the basis of the features of the invention, in the pole operating unit the counter-bearing of the contact force spring can be pushed in, after the legs of the carrier have been bent apart, until the pins can engage in the openings assigned to them. If the expansion force applied to the legs is then removed, the counterbearing is positively attached between the legs of the carrier. It is therefore unnecessary to provide additional attachment elements. It is known that the legs of the carrier can be made flexible by suitably selecting the thickness of the material. The carrier is therefore a relatively thin and lightweight part. Nevertheless, this part is capable of fulfilling its object of guiding the direction-changing lever arrangement reliably because the connection device connects the legs to one another and, as a result, a closed, stiff frame is formed.

A base, with a U-shaped cross-section, for a vacuum switching tube with a connection device which connects the legs is known per se (U.S. Pat. No. 4,684,771). However, a strengthening effect of a connection device and the rigidity of the base are not factors here because the said base only relates to the transmission of current from the movable connection bolt of the vacuum switching tube to the fixed connection device.

By means of further features, the vacuum switch according to the invention can be improved further. In particular, holes can be provided in the legs of the carrier as access opening to a clamping device on the movable operating plunger of the vacuum switching tube. Therefore, the vacuum switching tube can be installed or removed when the pole operating unit is otherwise completely assembled. A contribution can also be made to the strengthening of the pole operating unit by the support insulator being attached near to the end, facing the vacuum switching tube, of the carrier with the inclusion of an insulating support strut on the central part of the carrier, and by the edge of the central part being of rounded off and/or bent at the end of the carrier. The rounding-off or bending at the central part of the carrier is made easier by the relatively small crosssection of the material and leads both to local strengthening and also to an advantageous control of the course of the electrical field in this area.

Therefore, the support strut can be connected here to the central part of the carrier by positive engagement. This can also be advantageously achieved by means of bent-out pins which are located on the central part of the carrier.

In addition, the legs of the carrier can be provided with recesses which are open toward the edge, are aligned with the longitudinal axis of the pole operating unit and are intended for the insertion of a centering support of the associated vacuum switching tube.

As mentioned at the beginning, the connection device is also constructed as an assembly which connects and strengthens the legs. According to further developments of the invention, different designs are provided for according to the degree of heating to be expected.

At normal heating values, the connection device can be advantageously constructed as a U-shaped stamped and swaged component with a central part and legs, the legs of the connection device engaging over the legs of the carrier and the central part of the connection device serving as carrier of a connection contact face. If there is provision for both the U-shaped carrier and the connection device to be produced from sheet steel, it may be advantageous, at least for applications in the upper region of the intended rated current range, to provide the legs of the carrier with recesses, open at the edges, in the region of a flexible conductor which connects the movable connection bolt of the associated vacuum switching tube to the connection device. In this way, the cross-section of the closed iron ring is reduced in the region of the flexible conductor to such an extent that the heating due to eddy currents does not exceed an acceptable level.

For higher rated currents which lead to a greater degree of heating, it is advisable to construct the connection device as a U-shaped cast metal element which is provided with cooling ribs and has legs for engaging over the legs of the carrier and a central part which is free from ribs as a carrier of a connection contact surface.

The invention is explained in greater detail below with reference to the exemplary embodiments illustrated in the figures.

Figure 5:
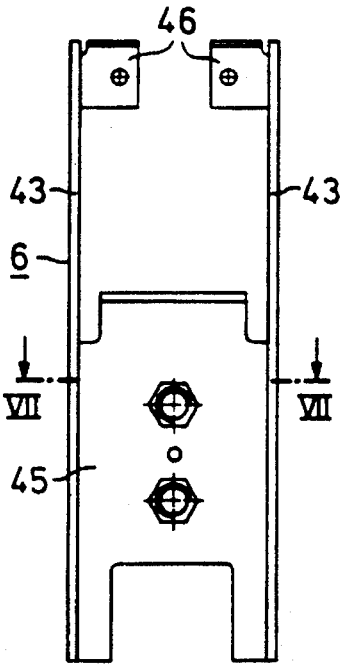
Figure 6:
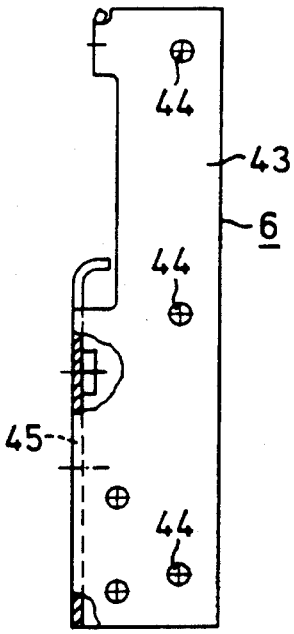
Figure 7:
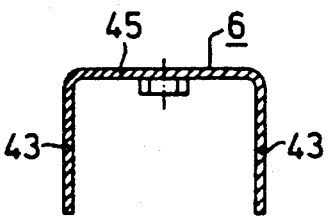

In FIGS. 5, 6 and 7, a bridge-like connection device which is constructed as a sheet-metal part is shown in an end view, a side view and in cross-section.

Figure 8:
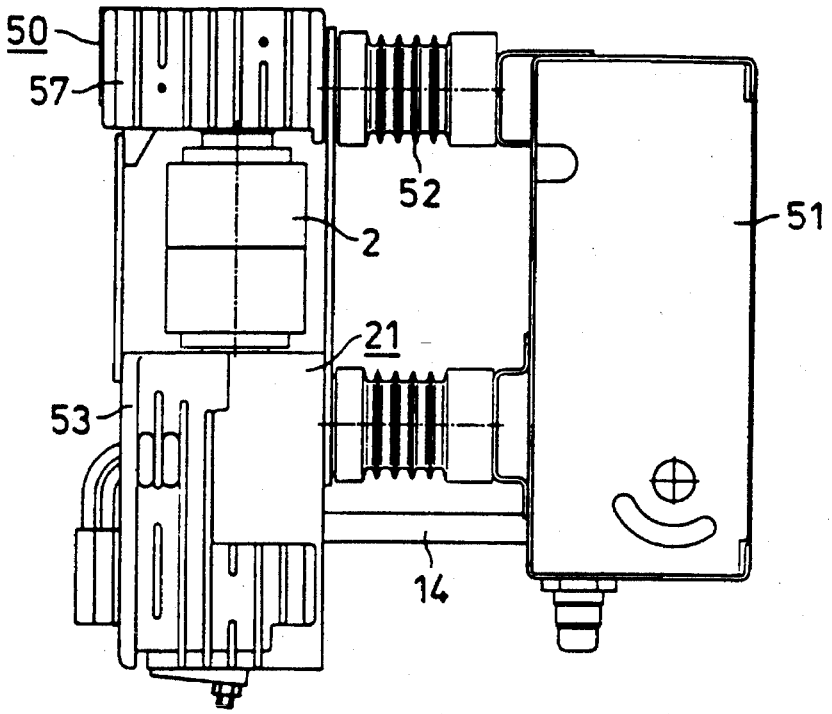

FIG. 8 shows a side view of a vacuum circuit-breaker with a connection device constructed as a cast ribbed element.

Figure 9:
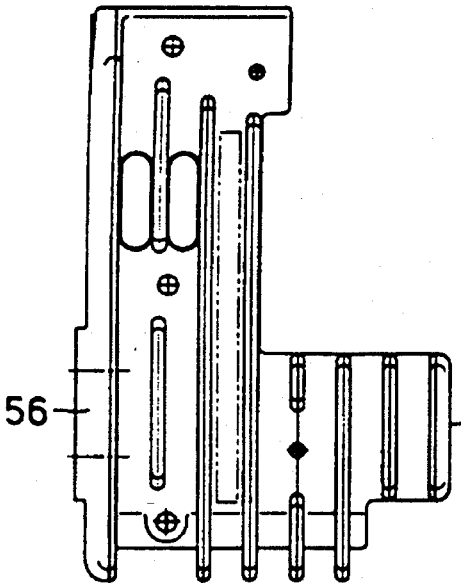
Figure 10:
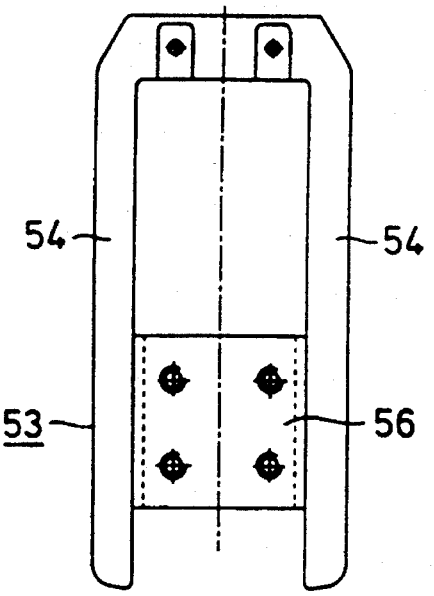
Figure 11:
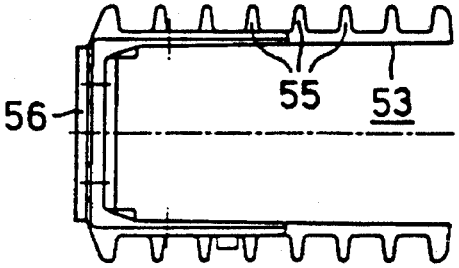

FIGS. 9, 10 and 11 show the connection device of the circuit-breaker according to FIG. 8 as an individual part in a side view, an end view and in plan view.

Figure 1:
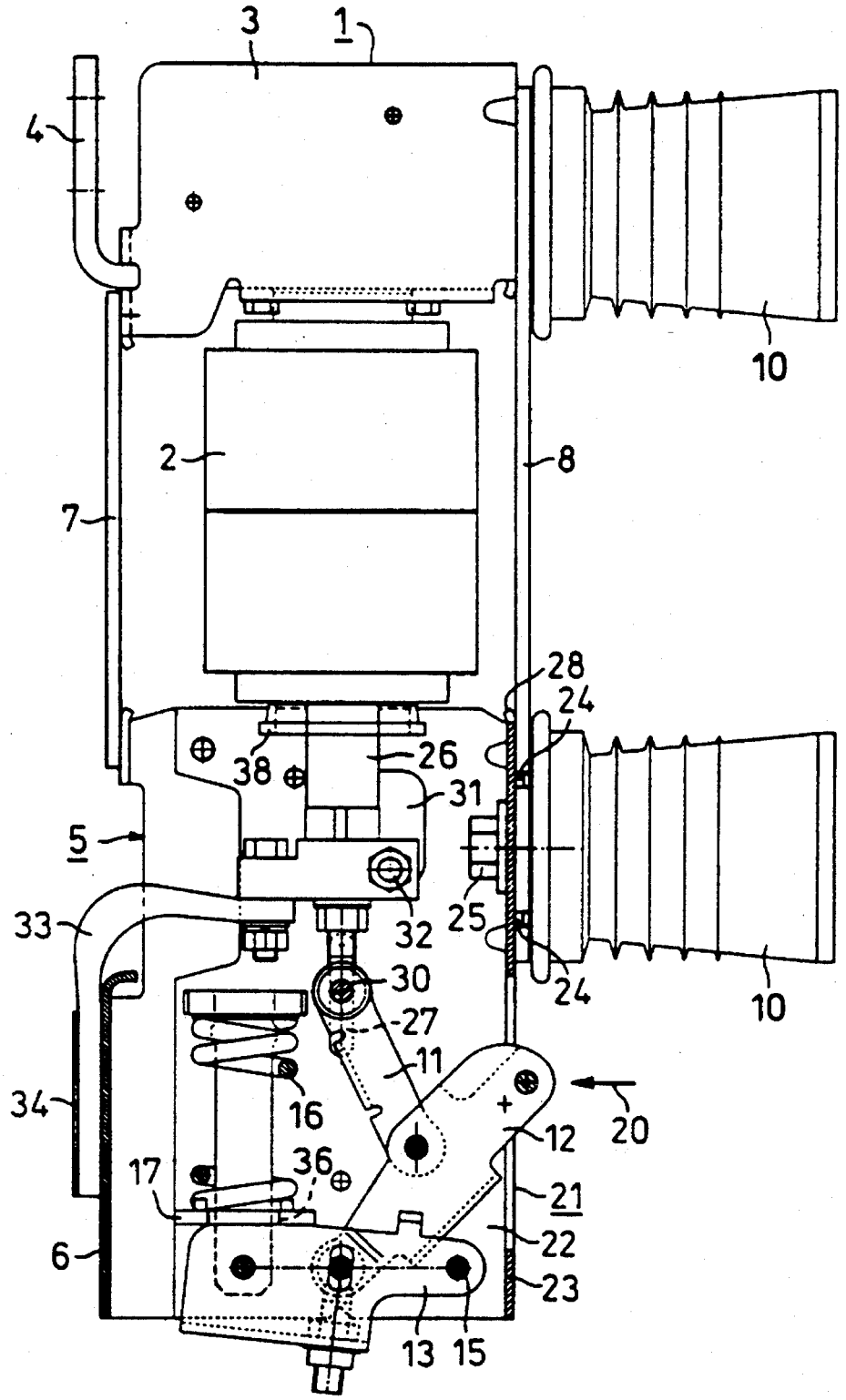
FIG. 1 shows a side view of a pole of a vacuum circuit-breaker with the support insulators which serve for attachment, but without drive device.

The pole unit 1 which is shown in FIG. 1 comprises a vacuum switching tube 2, a pole head 3 with an upper connection device 4 and a pole operating unit 5 with a lower connection device 6. The pole head 3 and the pole operating unit 5 are connected, for strengthening purposes, to two front insulating support struts 7 and a rear insulating support strut 8. In addition, in each case one support insulator 10 is attached to the pole head 3 and the pole operating unit 5. The support insulators 10 serve to attach the pole unit 1 to an earthed drive box (not illustrated) which contains a drive device for the pole unit 1. If a vacuum switch is of multi-pole construction, a plurality of pole operating units 5 with vacuum switching tubes 2 are attached by means of support insulators 10 to a common drive box (cf. drive box 51 in FIG. 8).

The pole operating unit 5 contains a lever arrangement which comprises an upper toggle lever 11, a lower toggle lever 12 and a support lever. An insulating coupling rod 14 which is not shown in FIG. 1 but is visible in FIG. 8 is to be connected to the lower toggle lever 12. The support lever 13 can be pivoted about a bearing bolt 15 and, in the switched-off state of the vacuum switching tube 2, can rest against a counterbearing 17 under the influence of a contact force spring 16 formed as a helical compression spring. Starting from the illustrated position of the parts, the vacuum switching tube 2 is moved into its switched-on position by an operating force being induced in the lower toggle lever 12 in the direction of the arrow 20.

As a consequence, the toggle levers 11 and 12 are moved into a position near to the extended position, the support lever 13 being lifted off the counter-bearing 17 after the switch contacts of the vacuum switching tube 2 have touched one another.

Figure 2:
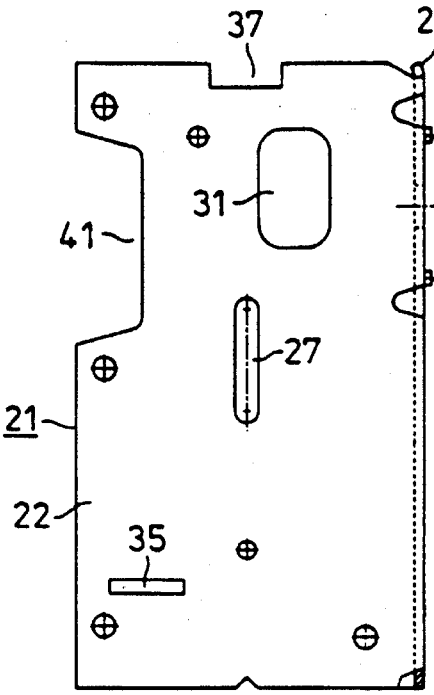
FIGS. 2, 3 and 4 show a side view, an end view and a plan view of the carrier of a pole operating unit of the circuit-breaker according to FIG. 1.
Figure 3:
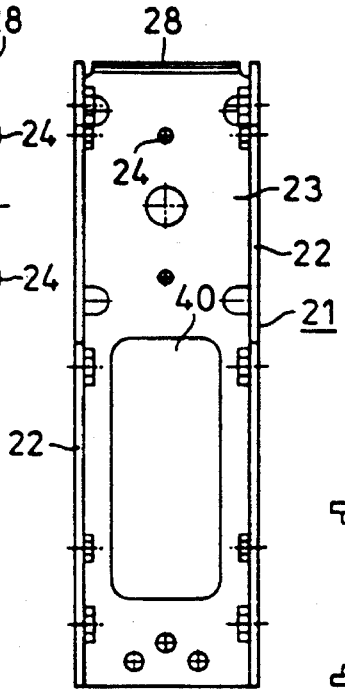
Figure 4:
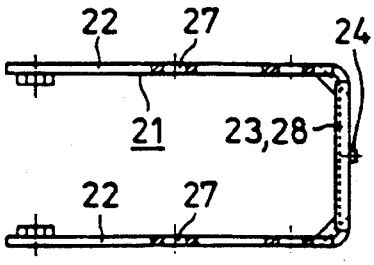

As FIG. 1 shows, the pole operating unit 5 has a carrier 21 which consists of sheet steel and is illustrated in greater detail in FIGS. 2, 3 and 4. As these figures show, the carrier 21 has, in the U-shaped basic form, two legs 22 and a central part 23. The central part 23 faces the support insulators 10 (FIG. 1 ). The rear support strut 8 is connected to the central part 23 by means of two pins 24 in a positively engaging fashion. The section of the support strut 8 which rests on the central part 23 serves at the same time as a support for the lower support insulator 10. By means of an attachment screw 25 which is indicated in FIG. 1, the lower support insulator 10 and the support strut 8 are thus attached to the pole operating unit 5 at the same time. The edges 28 of the central part 23 are of rounded-off construction for strengthening purposes and at the same time for the purpose of electrical load reduction.

In order to guide linearly a lower connection bolt 26 of the vacuum switching tube 2, the legs 22 of the carrier 21 are provided with aligned elongated holes 27 (FIG. 2). The ends of a guide bolt 30 which connects the upper toggle lever 11 to the movable connection bolt 26 in an articulated fashion engage in these elongated holes (FIG. 1 ). Above the elongated holes 27, there are holes 31 in the legs 22 through which a clamping device 32 is accessible, which clamping device 32 serves to connect a flexible conductor 33 to the movable connection bolt 26. The other end of the flexible conductor 33 ends at a connection contact surface 34 which is part of the connection device 6. According to FIG. 2, further features of the carrier 21 are narrow, rectangular holes 35 in the lower region of the legs 22, which holes 35 have pins 3 6 of the plate-shaped counter-bearing 17 of the contact force spring 16 which are an appropriate shape for engagement purposes. In order to install the counter-bearing 17, the carrier 21 is dimensioned in such a way that the legs 22 can be expanded elastically in order to position the pins 36 aligned in the region of the holes 35. After the expansion force is removed, the counter-bearing 17 is clamped in tight between the legs 22.

At the upper edge, the legs 22 of the carrier 21 have recesses 37 which are aligned with the longitudinal axis of the vacuum switching tube 2 and which are provided for a centering support 38 for the vacuum switching tube 2 to engage in. A further feature of the carrier 21 is a window-like hole 40 which is arranged in the central part 23 and serves to allow the insulating coupling rod 14 (shown in FIG. 8) to pass through, which coupling rod 14 is to be connected to the lower toggle lever 12 in the aforesaid manner. In addition, the legs 22 are provided with recesses 41 which are open at the edges and are located in the area through which the flexible connector 33 engages. The purpose of these recesses is to reduce the cross-section of the magnetic circuit which is formed about the current path if both the carrier 21 and the connection device 6 which is to be described later with reference to FIGS. 5, 6 and 7 are composed of a magnetically conductive material.

The connection device 6 according to FIGS. 5, 6 and 7 is also a sheet-metal part with a U-shaped crosssection with a shape which is matched to the carrier 21 in such a way that it engages with its legs 43 over the legs 22 of the carrier 21. Holes 44 in the legs 43 are provided for a screwed connection. At the end side, the connection device 6 is constructed 80 as to be open in the upper part for the flexible connector 33 to pass through. In the lower part there is a central web 45 which connects the legs 43 and is for the purpose of supporting the end, provided with the contact surface 34, of the flexible conductor 33. The upper ends of the legs 43 are provided with bent tabs 46 for the attachment of the front insulating support struts 7.

By means of the connection device 6, the carrier 21 is strengthened in such a way that, despite a relatively small cross-section of material, sufficient strength is obtained to absorb reliably the forces which occur without troublesome deformation. The heating of the carrier 21 and of the connection device 6 also remains low as a result of the recesses 41 in the legs 21. However, if the described vacuum circuit-breaker is to be operated in the region of very high rated currents, the heat which is to be dissipated out of the vacuum switching tube 2 cannot be dissipated completely from the described parts via the movable connection bolt 26. In this case, it is suitable to select a design of the connection device according to FIG. 8 and FIGS. 9, 10 and 11.

FIG. 8 is a diagrammatic view of a complete vacuum circuit-breaker with a pole unit 50, a drive device 51 and with support insulators 52 which connect the pole unit 50 and the drive device 51. The design of a connection device 53 which is connected to the carrier 21 of the pole operating unit is different in comparison with FIG. 1. The said connection device 53 is constructed as a cast metal element provided with ribs in order to increase its surface for the purpose of better dissipation of heat to the atmosphere. Details of this design are shown in FIGS. 9, 10 and 11, Similarly to the connection device 6 according to FIGS. 5, 6 and 7, the connection device 53 is constructed with a U-shaped cross-section in such a way that legs 54 engage over the legs 22 of the carrier 21. Ribs 55 extend in some cases over virtually the entire height of the carrier 21 and, to the extent that is permitted by the holes provided in the legs 22 of the carrier 21, also extend over the width of the legs 22. A central web 56 between the legs 53 serves, similarly as in the case of the connection device 6, to support the end of a flexible connector. FIG. 8 also shows that, in a manner corresponding to FIGS. 9, 10 and 11, the pole head 57 is also provided with ribs in order to ensure improved dissipation of heat also at the upper end of the vacuum switching tube 2.

What is claimed:

1. A vacuum switch comprising:

a) a vacuum switching tube having a movable operating plunger;

b) a drive device adapted to provide an operating force for said vacuum switching tube;

c) a pole operating unit, said pole operating unit i) receiving the vacuum switching tube at one of its ends, and ii) including A) a guide bolt adapted to linearly guide said operating plunger of said vacuum switching tube and adapted to transmit an operating force, B) a carrier, said carrier being a U-shaped sheet metal part including a central part and two legs, a distance between said two legs can be extended by elastic bending, each of said two legs having aligned elongated holes which receive ends of the guide bolt, each of said two legs having a second hole;

C) a lever arrangement which changes the direction of movement of the drive device, and D) a connection device, said connection device connecting said movable operating plunger of said vacuum switching tube to an external conductor, and connecting and strengthening said two legs of said carrier;

d) a support insulator connecting said drive device to said carrier and being attached, by one of its ends, to said central part of said carrier;

e) an insulating coupling rod connecting said drive device to said direction-changing lever arrangement;

f) a contact force spring adapted to be tensioned when said vacuum switching tube is switched on; and g) a counter-bearing, said counter-bearing i) supporting one end of said contact force spring, ii) fixed between said two legs of said carrier, iii) being plate-shaped, iv) having a width which corresponds to the distance between said legs in an unbent state, and v) having pins arranged on its narrow sides, said pins resting against said two legs of said carrier and engaging in said second holes of said two legs.

2. The vacuum switch of claim 1, further comprising a clamping device on said movable operating plunger of said vacuum switching tube, wherein said two legs of said carrier include access holes which permit access to said clamping device.

3. The vacuum switch of claim 1 wherein said support insulator is attached near to an end, facing said vacuum switching tube, of said carrier with the inclusion of an insulating support strut on a central part of said carrier, wherein an edge of said central part is at least one of rounded-off and bent.

4. The vacuum switch of claim 3, wherein said support strut and said central part of said carrier are connected to one another by positive engagement.

5. The vacuum switch of claim 1, wherein said two legs of said carrier include recesses, open toward an edge of said two legs, aligned with a longitudinal axis of said pole operating unit, and permitting a centering support of said vacuum switching tube to be inserted.

6. The vacuum switch of claim 1 wherein said connection device is a U-shaped stamped and swaged component having:

a central web, said central web being a carrier of a connection contact surface; and two legs, said two legs of said connection device having inner surfaces which engage outer surfaces of said two legs of said carrier.

7. The vacuum switch of claim 6, further comprising a flexible conductor which connects said movable operating plunger of said vacuum switching tube to said connection device, wherein said two legs of said carrier have recesses, open at edges, in the region of said flexible conductor.

8. The vacuum switch of claim 1, wherein said connection device is a U-shaped cast metal element provided with cooling ribs and having legs engaging outside said two legs of said carrier and having a central part being a carrier of a connection contact surface.

9. The vacuum switch of claim 1, said connection device further comprises:

i) a central web, ii) a first connection leg and a second connection leg, said first and second connection legs of said connection device being substantially parallel to one another, said first connection leg having an inner surface which at least partially contacts an outer surface of said first leg of said U-shaped carrier, and said second connection leg having an inner surface which at least partially contacts an outer surface of said second leg of said U-shaped carrier.

* * * * *